US005636931A

United States Patent [19]

Gueret

[11] Patent Number: 5,636,931

[45] Date of Patent: Jun. 10, 1997

[54] APPLICATOR DEVICE WITH A PERFORATED PISTON

[75] Inventor: Jean-Louis Gueret, Paris, France

[73] Assignee: L'Oreal, Paris, France

[21] Appl. No.: 447,946

[22] Filed: May 23, 1995

[30] Foreign Application Priority Data

May 24, 1994 [FR] France ..... 94 06275

[51] Int. Cl.[6] ..... A45D 34/00; A45D 40/00

[52] U.S. Cl. ..... 401/126; 401/127; 401/129; 401/130

[58] Field of Search ..... 401/130, 129, 401/126, 119, 127

[56] References Cited

U.S. PATENT DOCUMENTS

| | | | |
|---|---|---|---|
| Re. 21,757 | 4/1941 | Deakers et al. . | |
| 1,362,808 | 12/1920 | McFarland . | |
| 1,375,938 | 4/1921 | Slack | 401/130 |
| 4,929,108 | 5/1990 | Gueret | 401/139 X |

FOREIGN PATENT DOCUMENTS

| | | | |
|---|---|---|---|
| 0263329 | 4/1988 | European Pat. Off. . | |
| 0384026 | 8/1990 | European Pat. Off. . | |
| 0416185 | 3/1991 | European Pat. Off. . | |
| 1185015 | 7/1959 | France . | |
| 55773 | 6/1912 | Germany | 401/130 |
| 9207228.3 | 10/1992 | Germany . | |
| 314959 | 1/1930 | United Kingdom . | |
| 2210849 | 6/1989 | United Kingdom | 401/126 |

*Primary Examiner*—Steven A. Bratlie
*Attorney, Agent, or Firm*—Young & Thompson

[57] ABSTRACT

An applicator device for a non-gaseous product (12), comprising an axis of symmetry (X—X), a reservoir (11) containing this product, a cap (2) intended to close the reservoir (11) and an applicator carrier (4) joined to the cap (2) and supporting an applicator element (5) capable of taking up the product. A piston (13) in the reservoir (11) between the product and the applicator element (5) has at least one opening (14) for the emergence of the product and a spring (17) to ensure a pressure of the applicator element (5) on the piston in order to cause the product to emerge through the opening (14) and thus to take up some of the product on the applicator element (5) during the application of the cap (2) on the reservoir (11), the piston being capable of displacement solely in the direction of the axis (X).

14 Claims, 3 Drawing Sheets

APPLICATOR DEVICE WITH A PERFORATED PISTON

The present invention related to an applicator device for a non-gaseous product and its use in the fields of cosmetics and/or dermatology. This device is more particularly intended for the application of a liquid, pasty, gelled, creamy or pulverulent product for make-up and/or skin care, including the scalp, the eyelashes and the mucous membranes.

This product is more precisely a lipstick, a cheek blusher, a treatment cream, or a mascara.

The conventional devices for applying a make-up or care product include in particular a body wherein there is accommodated a reservoir containing the product, a cap intended to close the body and hence the reservoir, and an applicator carrier joined to the cap and which supports an applicator element (or applicator) capable of taking up some of the product.

Such a device is described in particular in FR-A-2 633 167 for the application of a product, and in particular of a mascara or eve shadow. It also comprises means for compacting the product and resilient means for restoring these compacting means into their rest position, these means being accommodated in the body of the device. These compacting means have the function of charging the applicator element, or applicator, with the product. With this device, the applicator is wholly submerged in the product which subsequently does not make it possible to obtain very precise and point-wise application of the product on the skin and/or the eye-lashes. Moreover, the seal is inadequate at the level of the applicator element, in particular, if the product concerned is a liquid or creamy product.

This unit is also provided with a circuit for evacuating the air, including a duct cut in the applicator carrier; this circuit has the function of evacuating the air which penetrates into the reservoir after each insertion of the applicator into the reservoir. Unfortunately, because of its ventilating action, this air evacuation circuit causes the solvents of the product to evaporate. There follows a compacting of a dried-out product which can no longer be taken up, and hence a premature consignment of the device to the dustbin.

Moreover, from FR-A-2 701 818 devices are known for the application of a liquid product to the skin, whose upper reservoir portion is provided with a nozzle with a capillary orifice through which the liquid product passes. In this device, the element for the application of the product, which is deformable, can assume the shape of the capillary orifice with which it enters into contact when the device is closed, so as to take up by capillarity a given quantity of the liquid product.

This applicator device is not suitable for taking up a viscous or pulverulent product.

Thus there remains the need for a metering applicator device for a product in the form of a paste, a gel, a loose powder or a cream which allows a metered quantity of the product to be taken up on the end portion of the applicator, while preventing on the one hand the settlement of the viscous product at the bottom of the reservoir, produced by the repeated insertions of the applicator element into the reservoir, and on the other hand its drying out following the evaporation of the solvents which make it possible to use up the product to the end, and also preventing wholesale pollution by the introduction of contaminants.

It has been surprisingly observed that the use of a perforated piston, in contact with the product subjected to compression by a resilient means, allowed a viscous or pulverulent product to be taken up in a uniform and precise way and prevented the compacting of the product in the bottom of the reservoir, as well as its drying out.

More particularly, the invention provides an applicator device for a non-gaseous product which comprises an axis of symmetry, a reservoir containing this product, a cap intended to close the reservoir, an applicator carrier joined to the cap end supporting an applicator element capable of taking up some of the product, a piston placed in the reservoir between the product and the applicator element and having at least one opening for the emergence of the product, and a resilient means to ensure a pressure of the applicator on the piston in order to cause the product to emerge through the opening, and thus to take up some of the product on the element during the application of the cap to the reservoir, the piston being capable of displacement only in the direction of the axis.

In accordance with the invention, the piston bearing on the product present in the reservoir is thus longitudinally movable in the latter. The fuller the reservoir, the higher is the position of the piston in the reservoir.

The piston may be semi-deformable and be made of a polymeric material such as low density polyethylene, high density polypethylene, polypropylene, polyacetal, elastomers, or thermoplastic elastomers. Advantageously, it is pierced by at least one opening, placed at its centre or at the side, and in the surface deployed by the applicator element in compression. This opening is calibrated according to the nature and consistency of the product to be taken up. It permits the passing of a metered and precise quantity of the product.

The opening of the piston has, in particular, a width or a diameter ranging from 0.2 mm to 20 mm, and preferably ranging from 0.8 mm to 6 mm.

As a variant, in particular when it is intended to apply a liquid, pasty or creamy product, the orifice of the piston may be constituted by a microporous or grille-shaped zone that is permeable to the product, it being possible for this zone to be made of a nondeformable sintered or spongy material with open cells.

Preferably, the piston comprises, moreover, at least one which bears on the internal wall of the reservoir. When the applicator is closed, the pressure exerted by the end of the applicator element on the piston entails a deformation of the end of the applicator element in the piston opening, end a reduction of the thickness of the wall of the piston which is situated near the opening, thus producing the seal of the applicator device and leading to the take up of a given quantity of the product, whilst inhibiting any leakage of the product.

The shape of the piston depends on that of the end of the applicator and vice versa. Thus the piston may preferably have a spherical, oval, planar, pointed, square or triangular shape, according to as to whether the applicator has a shape chosen from spherical, oval, planar, pointed, square or triangular shapes. Thus when the piston has a spherical or oval shape, the end of the applicator element has a convex shape matched to the shape of the piston.

When the piston had a planar shape, that is to say, when the planar surface of the piston in contact with the applicator element is disposed perpendicularly to the internal side of the reservoir, the opening of the piston is situated preferably at its centre. In this case, the applicator element may preferably comprise a recess in its lower portion, thus making it possible by an absorption phenomenon to take up a larger quantity of the product from the reservoir. In this recess, there may be inserted, if required, an elastomeric foam with open cells, the periphery of the foam serving for the sealing of the device, and the centre of the foam for the charging and metering of the product. Advantageously the piston has, moreover, a cavity directed towards the applicator element and which allows a portion of the product to be taken up to be stored.

The applicator element may be constituted by a block of a deformable foam, a block of flocked foam, a fine flexible rubber containing a foam or a spring, a soft rubber having roughened portions, a felt, a brush with short and hard bristles or a mascara brush.

The foam is chosen in particular from polyether foams, polyurethane foams, polyester foams, low density elastomeric foams, and flocked foams.

The low density elastomers are defined by a Shore A hardness ranging from 15 to 90.

The foams are, preferably, chosen from closed cell foams having a pore opening ranging from 0.05 mm to 2 mm and preferably from 0.5 mm to 0.8 mm. They have, in particular, the appearance of a sponge.

The applicator element is preferably fixed to the cap by means of a stem, for example, a hollow stem mounted in a rigid sleeve provided with a transverse cylindrical extension which ensures the hold of the stem in the cavity of the cap. This stem, this sleeve and this extension form part of the applicator holder.

The reservoir surmounted by the piston can be fitted in a body. This body includes, in its upper portion directed towards the cap, preferably a thread system or a screw thread which makes it possible to close the cap by catch engagement or by screwing respectively, the portion of the cap fitted in the body having a shape complementary to the upper portion of the body.

The resilient means bears either on an inner side of the cap and the applicator carrier or on the bottom of the body and the bottom of the reservoir, or an inner side of the cap and on the applicator element. It may also be disposed in the applicator element. This resilient means is preferably constituted by a coil spring, a leaf spring, a rubber, or any other resilient system such as a foam.

A screw mechanism may also be envisaged with a dynamometric disengagement, that is to say, that the mechanism is disengaged beyond a certain pressure exerted on the applicator, in a manner comparable to a micrometer.

The device in accordance with the invention may find its application more particularly in the field of make up and/or skin care and may in particular constitute a powder compact, a tube for making up the lips end/or for the eyelids and/or cheeks, a mascara tube or an applicator tube for skin care.

Thus the invention moreover provides a device for applying a liquid, pasty, creamy, galled or pulverulent make-up product, consisting of a device such as described above.

The invention also relates to the use of the device such as defined above for applying the product contained in the reservoir to the skin, the lashes or the mucous membranes, by means of the applicator element.

The invention will now be described in a more detailed and non-restrictive manner by means of the attached drawings, and wherein:

FIG. 1 schematically shows a general view, in perspective, of an applicator device in accordance with the invention;

Figure 5A:
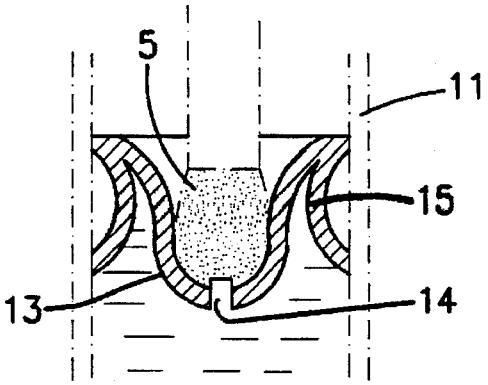
Figure 5B:
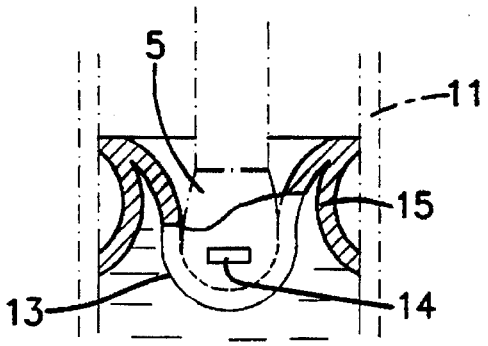
Figure 6A:
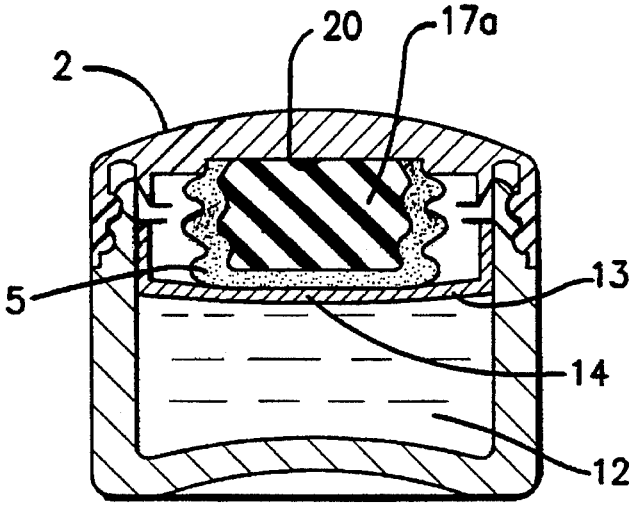
Figure 5C:
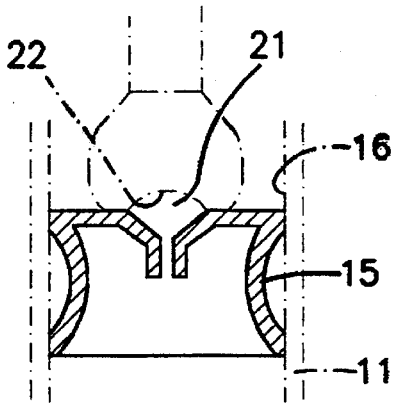
Figure 7:
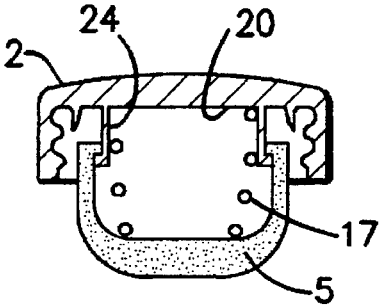
Figure 6B:
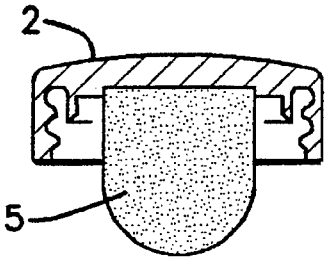
Figure 8:
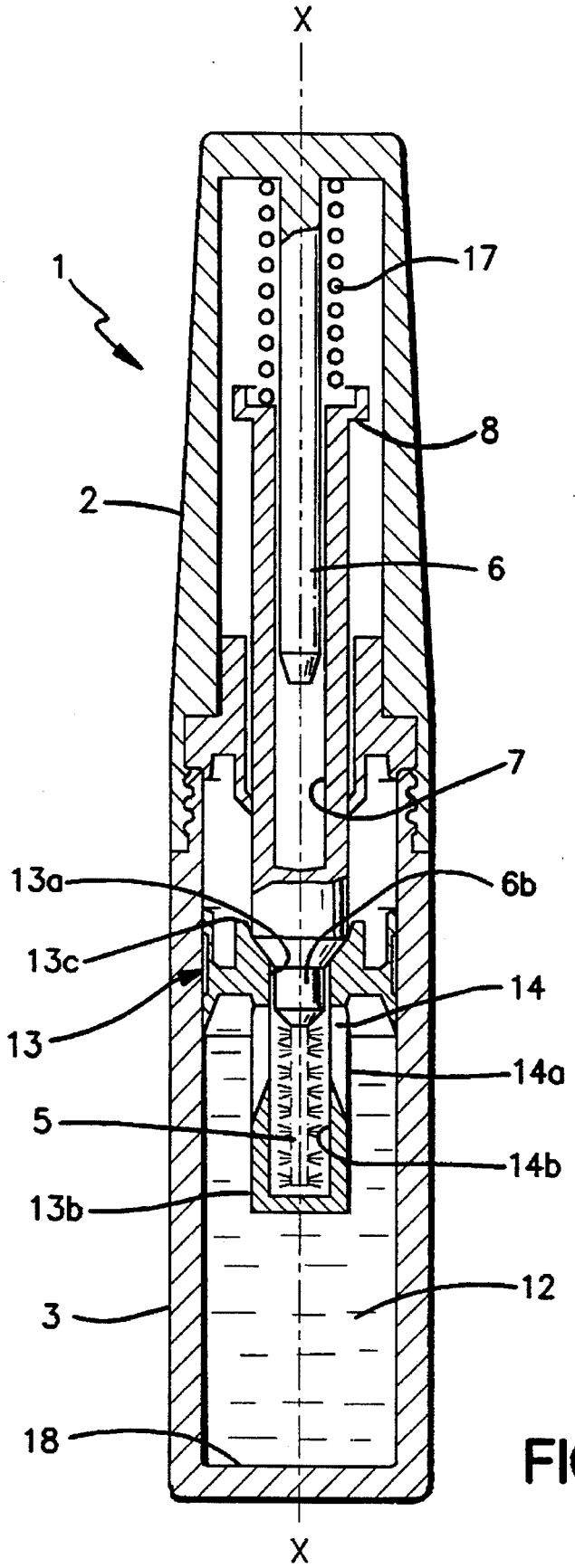

FIGS. 5*a*, 5*b*, 5*c* each show a sectional view of a different embodiment of the piston and of the applicator element of the device in accordance with the invention;

FIGS. 6*a* and 6*b* show a variant of the embodiment of the applicator device in accordance with the invention;

FIG. 7 shows another variant of the embodiment of the applicator device in accordance with the invention; and FIG. 8 represents a variant of the embodiment of the piston in accordance with the invention.

Figure 1:
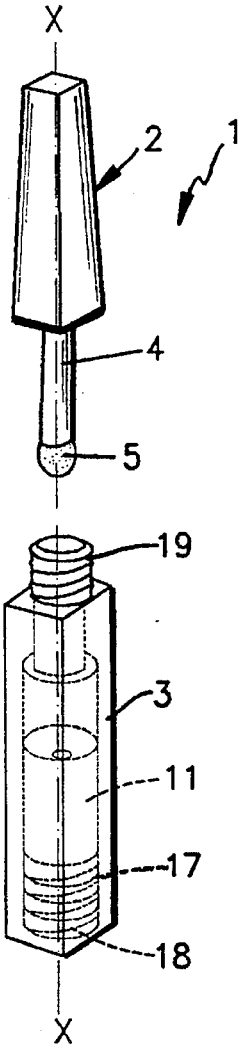
Figure 2:
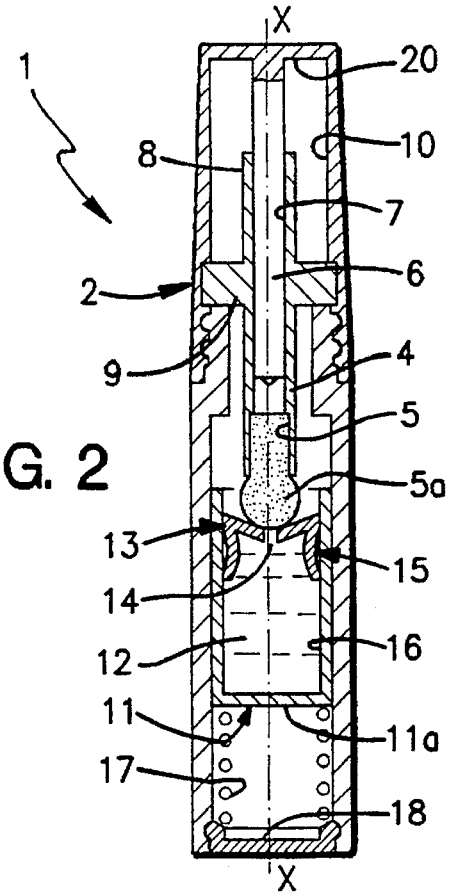
FIG. 2 shows a sectional view of the device of FIG. 1.

In FIGS. 1 and 2, an applicator device of the invention designated overall by the reference numeral 1 has been respectively shown in an open and closed position. This device, having an axis of symmetry X—X, comprises a cap 2 and a hollow body 3 intended to be fixed to each other. In the cavity 10, of the cap 2 of conical shape, there is accommodated a rigid applicator carrier 4 supporting an applicator element 5 emerging from the cap.

The applicator carrier 4 has a stem 6 pierced by a bore 7 which is force-fitted in a sleeve 8 that comprises transversely a skirt 9 bearing on the inner side wall of the cap 2, and thus ensuring the holding in position of the stem 6 in the cavity 10 of the cap 2.

The applicator element 5 is fixed to the lower end of the hollow stem 6 on the opposite aide to the bottom 20 of the cap. The applicator element is formed by a foam block with open cells having pore openings of 0.8 mm, this block ending in a ball 5*a*.

The body 3 encloses a reservoir 11 with an axial symmetry containing a product 12, for example, a pasty product, such as a make-up or a lipstick, to be applied to the mucous membranes or to the skin. The reservoir 11, having a length shorter than that of the body 3, is provided at its upper portion and opposite the flexible applicator element 5 with a flexible piston 13 that is movable along the X—X axis and is pierced by an opening 14.

The opening 14 is centred on the piston, and is hence in the axis X—X of the device. The piston 13 which is M-shaped in the plane of the Figure, has a flexible lip 15 which bears on the inner side 16 of the reservoir 11. The reservoir 11 is mounted on a helical spring 17 which is itself fitted in the bottom 18 of the body 3. In the representation of FIG. 2, the spring 17 is compressed between the bottom 11*a* of the reservoir and the bottom 18 of the body 3.

In the representation in an open position of FIG. 1, the spring 17 is slack. In this Figure, the neck 19 has been represented on the opposite side to the bottom 18 of the body 3. This neck is constituted by a cylindrical tubular element whose external diameter is slightly larger than that of the applicator element 5, so as to introduce the element 5 into the container 11. This neck 19, as well as the lower internal side of the cap 2, have a screw thread allowing the device to be closed by screwing. The set of the cap, body and applicator carrier 4 are made of a rigid plastic material, for example, of polyethylene.

The screwing (or catch engagement) of the cap 2 on the body 3 causes the spherical end 5*a* of the applicator element 5 to press on the opening 14 of the piston 13, the liquid to emerge by pressure, and consequently the applicator element 5 to be charged with the product by absorption. The closing of the device 1 also causes the spring 17 to be compressed. Under the pressure of the applicator element 5 and the effect of the compressed spring 17, the opening 14 of the piston 13 opens and the free end of the lip 15 of the piston 13 is applied against the inner side 16 of the reservoir 11, while the free end moves away from this side, thus allowing a given and precise quantity of the product to pass in the direction towards the applicator element 5. The applicator element 5 is then charged at its spherical portion with a given product dose.

When the device is open, the spring 17 is decompressed. The piston 13 reassumes its rest position, and the opening 14 closes, at least partly. The product taken up by the applicator can then be applied to the skin or the mucous membranes.

Figure 3:
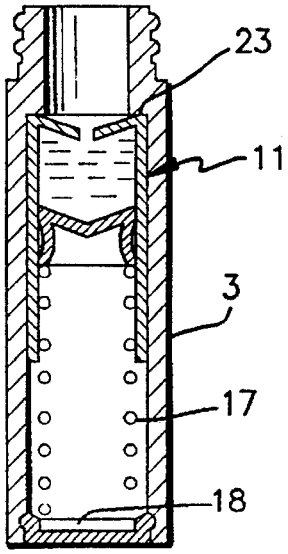
FIG. 3 shows a sectional view of a particular position of the reservoir in the body of the applicator of FIG. 1.

In FIG. 3, only the body 3 of the device of the invention hag been represented. In this Figure, the spring 17 is decompressed and causes the reservoir 11 to rise towards the upper portion of the body 3, the reservoir coming to bear on a shoulder 23 of the body that supports the neck 19.

Figure 4:
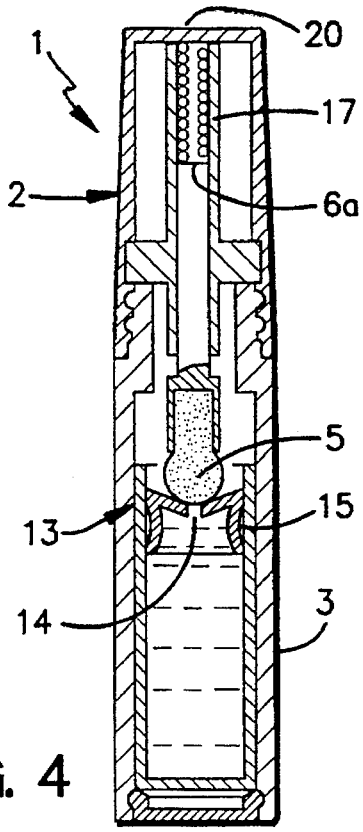
FIG. 4 is similar to FIG. 2, but the resilient means bears on the cap and the applicator carrier.

In the variant of FIG. 4, the spring 17 bears on the bottom of the cap 2 and on the upper end 6*a* of the stem 6 of the applicator carrier 4.

In the variants of FIGS. 5*a*, 5*b* and 5*c*, various shapes of the piston have been represented. The piston 13 is provided with an opening 14 placed at its centre (FIGS. 5*a* and 5*c*) or at the side (FIG. 5*b*).

In FIGS. 5*a* and 5*b*, the piston 13 has, moreover, an oval shape. The applicator element 5 is in direct contact with the piston assembly and accurately assumes its shape.

In the variant of FIG. 5*c*, the bearing surface of the piston 13 on the applicator element 5 is planar and is perpendicular to the internal side 16 of the reservoir 11. It has a central cavity 21 serving to store the product and facing the applicator element 5. Moreover, the applicator element 5 has a scooped-out portion 22 in its lower part which makes it possible to take up by absorption a quantity of the product that is greater than that in the variants of FIGS. 5*a* and 5*b*. The pressure of the applicator element 5 ensures a greater spread of its end on the piston.

The variant of the device in accordance with the invention represented in FIGS. 6*a* and 6*b* shows a powder compact containing a powder 12 to be applied to the skin. The foam applicator element 5 is fixed by bonding to the resilient means, here taking the form of a compressible rubber block 17*a*. When the device is closed, the resilient means 17*a*, which forms an integral part of the applicator element, is squashed against the opening 14 of the piston 13. The rubber 17*a* may be fixed to the bottom 20 of the cap by bonding.

In the variant of FIG. 7, the resilient means 17 which is a helical spring, is accommodated in the foam and bears on the bottom 20 of the cap and the foam 5. The foam may be bonded to the bottom 20 of the cap or be fastened to a skirt 24 with a hook-shaped end, which is joined to the cap.

The devices represented in FIGS 1 to 7, because of the shape of the applicator element 5, are more particularly intended to be applied to a cheek blusher or a lipstick.

However, the invention also applies to a mascara tube such as that shown in FIG. 8. In this case, the applicator element 5 may be a brush.

The device of FIG. 8 is distinguished primarily from the devices of the other Figures by the fact that it is the body 3 which serves as the reservoir for the product 12.

In FIG. 8, the piston 13 has an axially extending duct 13*b* and wherein there is accommodated the brush 5. This duct 13*b* is provided with one or several longitudinal grooves 14*a* ending in one or several side openings 14 which cause the body 3 and the duct 13*b* to communicate. The duct is closed at its end opposite the bottom 18 of the body 3.

When the device is being closed, the brush 5 enters into contact with the piston 13 end exerts pressure on it. Under this pressure, the inner wall 13*a* of the funnel-shaped piston 13 becomes thinner by elastic deformation.

Under the effect of this pressure, the product 12 enters into the duct through the opening 14 and flows by capillarity along the inner side 14*b* of the duct 13*b*.

In the closed position, the seal of the applicator device is ensured by a very intimate contact between the inner wall 13*a* and the end 6*b* of the stem 6 supporting the brush. For this purpose, the end 6*b* has a conical shape complementary to that of the inner wall 13*a* of the piston. This prevents the product 12 contained in the duct 13*b* from rising up by capillarity towards the upper surface 13*c* of the piston 13 which is perpendicular to the axis X—X, and hence any flowing out into the part of the body 3 situated above the piston.

Apart from the advantages set out above, the device of the invention makes it, moreover, possible to target the point of the applicator element which is impregnated by the product. The impregnation of this element may be effected either at its end (FIGS 1 to 7) or over the whole of the element (FIG. 8).

Moreover, the applicator device in accordance with the invention allows an accurate take up of products having very different viscosities (a large viscosity range).

Furthermore, the advantage of using such a device lies, in particular, in the fact that the applicator element does not dip into the whole of the product for taking up a given quantity thereof, and hence avoids soiling the product by introducing contaminants. Indeed, the piston provided with at least one opening, such as defined in accordance with the invention, allows the applicator element to be in contact with only a portion of the product to be taken This applicator device with a perforated piston makes it possible moreover to use up the whole of the product in the reservoir, whatever its viscosity. Indeed, this device avoids any retention of the product and hence its drying out on the inner sides of the reservoir, and this in particular as far as viscous products are concerned.

The present invention is not limited to the embodiments described which have been given solely by way of illustration.

I claim:

1. A device for applying a nongaseous product, comprising a reservoir having an axis of symmetry, said reservoir being adapted to contain said product, a cap adapted to close the reservoir, an applicator carried by the cap, said applicator being capable of taking up said product, a barrier in the reservoir adapted to be disposed between said applicator and a said product in the reservoir, the barrier being of resilient material and having at least one opening therethrough, through which opening said product can move into contact with and be taken up by said applicator, and means yieldably urging the applicator and the barrier into contact with each other with a pressure exerted by said applicator on said barrier sufficient to enlarge said opening, said applicator closing said enlarged opening when in contact with said barrier, the resilience of said barrier causing said opening at least partially to close when the applicator is out of contact with the barrier.

2. A device as claimed in claim 1, said yieldably urging means comprising resilient means bearing said barrier.

3. A device as claimed in claim 1, said yieldably urging means comprising means resiliently bearing on said applicator.

4. A device as claimed in claim 1, said barrier having a cavity therein that opens toward the applicator and that matches an external contour of said applicator.

5. A device as claimed in claim 1, said opening being disposed along said axis.

6. A device as claimed in claim 1, said opening being offset from said axis.

7. A device as claimed in claim 1, said resilient barrier comprising a piston slidable axially in said reservoir.

8. A device as claimed in claim 1, said barrier being fixed in position along said axis, and a piston slidable along said axis and adapted to urge said product toward said opening.

9. A device as claimed in claim 1, said urging means urging said reservoir toward said applicator.

10. A device for applying a nongaseous product, comprising a reservoir having an axis of symmetry, said reservoir being adapted to contain said product, a cap adapted to close the reservoir, an applicator carried by the cap, said applicator being capable of taking up said product, a barrier in the reservoir adapted to be disposed between said applicator and a said product in the reservoir, the barrier having at least one opening therethrough, through which opening said product can move into contact with and be taken up by said applicator, the cap urging the applicator and the barrier into contact with each other to close said opening when the cap is fully seated on the reservoir, and means continuously urging said product and said opening into contact with each other.

11. A device as claimed in claim 10, in which said urging means comprise a partition in said reservoir on the side of said product opposite said opening, and means continuously urging said partition toward said opening.

12. A device as claimed in claim 11, said urging means comprising a coil compression spring disposed between said partition and a closed end of said reservoir.

13. A device as claimed in claim 10, wherein said urging means acts between said cap and said applicator and the barrier is slidable in the reservoir.

14. A device as claimed in claim 13, wherein said urging means comprises a coil compression spring disposed between said applicator and said cap.

* * * * *